US005664284A

United States Patent [19]

Brzoska

[11] Patent Number: 5,664,284

[45] Date of Patent: Sep. 9, 1997

[54] APPARATUS FOR OPENING CLOGGED AND SLOW DRAINS

[75] Inventor: Henry G. Brzoska, Stamford, Conn.

[73] Assignee: Lemaks Industries, Inc., Stamford, Conn.

[21] Appl. No.: 512,122

[22] Filed: Aug. 7, 1995

[51] Int. Cl.[6] ..... A47L 5/14

[52] U.S. Cl. ..... 15/330; 15/344; 15/353; 15/406; 4/255.06

[58] Field of Search ..... 15/330, 353; 4/255.06

[56] References Cited

U.S. PATENT DOCUMENTS 3,238,556 3/1966 Martin ..... 15/330

5,193,245 3/1993 Brzoska ..... 15/330

5,243,733 9/1993 Steiner et al. ..... 15/330

*Primary Examiner*—Chris K. Moore

*Attorney, Agent, or Firm*—Patrick J. Walsh

[57] ABSTRACT

An apparatus for opening drains and the like includes a suitable vacuum/pressure source such as the inlet/outlet ports of an enclosed motor driven fan, together with a control mechanism for selectively applying vacuum/pressure pulses to a partially or completely blocked drain for loosening and purging the blockage. A lightweight portable unit including vacuum/pressure sources, control mechanism, collection receptacle, and associated air pressure/vacuum ducts is disclosed.

3 Claims, 6 Drawing Sheets

APPARATUS FOR OPENING CLOGGED AND SLOW DRAINS

BACKGROUND OF THE INVENTION

The present invention relates to an apparatus for clearing plumbing drains that are clogged with refuse and do not drain properly.

U.S. Pat. Nos. 4,933,017; 5,105,504; and 5,193,245 of common ownership with the present application are each directed to an apparatus for opening drains. The patented apparatus includes a pressure source and a vacuum source provided at the outlet and inlet ports, respectively, of an air fan together with a control manifold for selectively applying air pressure pulses and vacuum pulses to the drain via an air duct. Sequential application of pressure pulses and vacuum pulses to the drain line results in dislodging the cause of drain blockage, and clears the drain either by pressure pulse propelling refuse down the drain, or by vacuum pulse drawing the refuse from the drain line into an evacuated collection receptacle forming part of the apparatus.

The patented apparatus is suitable for clearing commercial, industrial, and household drains and may be used for purging cooling systems for automotive and marine engines.

This application discloses improvements to these patented drain opening devices.

SUMMARY OF THE INVENTION

The present invention provides an apparatus for opening drains and the like and includes a suitable vacuum/pressure source such as the inlet/outlet ports of an enclosed motor driven fan, together with a control manifold for selectively applying vacuum/pressure pulses to a partially or completely blocked drain for loosening and purging a blockage. A lightweight portable unit including vacuum/pressure sources, control manifold, collection receptacle, and associated air pressure/vacuum ducts is disclosed.

In a preferred embodiment of the invention, an apparatus for opening drains includes a unitary, handheld device with component parts arranged vertically, and with the device applied vertically to the inlet opening of a blocked drain.

From top down, the apparatus includes a grip and manipulating handle for selectively applying vacuum/pressure pulses, encased motor and air blower with power line and motor controlling switch, control manifold for directing vacuum/pressure pulses to the drain, a see-through collection receptacle, and inlet/outlet duct from receptacle to drain for directing vacuum/pressure pulses to the drain and for directing to the receptacle any liquid and/or effluent drawn from the drain by a vacuum pulse.

The collection receptacle may include a transparent wall enclosure or a window in the enclosure wall for revealing the presence of foreign matter in the receptacle. Any foreign matter present in the receptacle can be returned to a reopened drain by applying a positive air pressure pulse to the receptacle.

A variety of drain connecting accessories are disclosed facilitating application of the apparatus to different kinds of drain openings.

The invention may be employed in portable field use where no electricity is available, and for this application a small gas engine may be used to power the blower for the apparatus.

OBJECTS OF THE INVENTION

It is an object of the invention to provide a unitary, handheld apparatus for opening drains.

It is an object of the invention to provide a device for opening drains with component parts arranged vertically, and with the device applied vertically to the inlet opening of a blocked drain.

It is a further object of the invention to provide a device for opening drains which includes a collection receptacle having a transparent wall portion for revealing the presence of foreign matter in the receptacle and further having means for purging the receptacle with a pressure pulse applied by the device.

It is a further object of the invention to provide a device for opening drains with a set of drain accessories for clearing different types and styles of drains.

It is a further object of the invention to provide a device for opening drains adapted for one-hand operation.

It is a further object of the invention to provide a device for opening drains of robust compact construction capable of clearing different kinds of drains with minimal mess of the area around the drain.

It is another object of the invention to provide a device for opening drains with accessories that aid in cleanup of other drain cleaning tools such as plumber's snakes often used in probing and clearing drains.

Other and further objects of the invention will occur to one skilled in the art with an understanding of the following detailed description of the invention or upon employment of the invention in practice.

DESCRIPTION OF THE DRAWING

A preferred embodiment of the invention has been chosen for purposes of illustrating the construction and operation of the invention and is shown in the accompanying drawing in which.

DETAILED DESCRIPTION OF THE INVENTION

Figure 1:
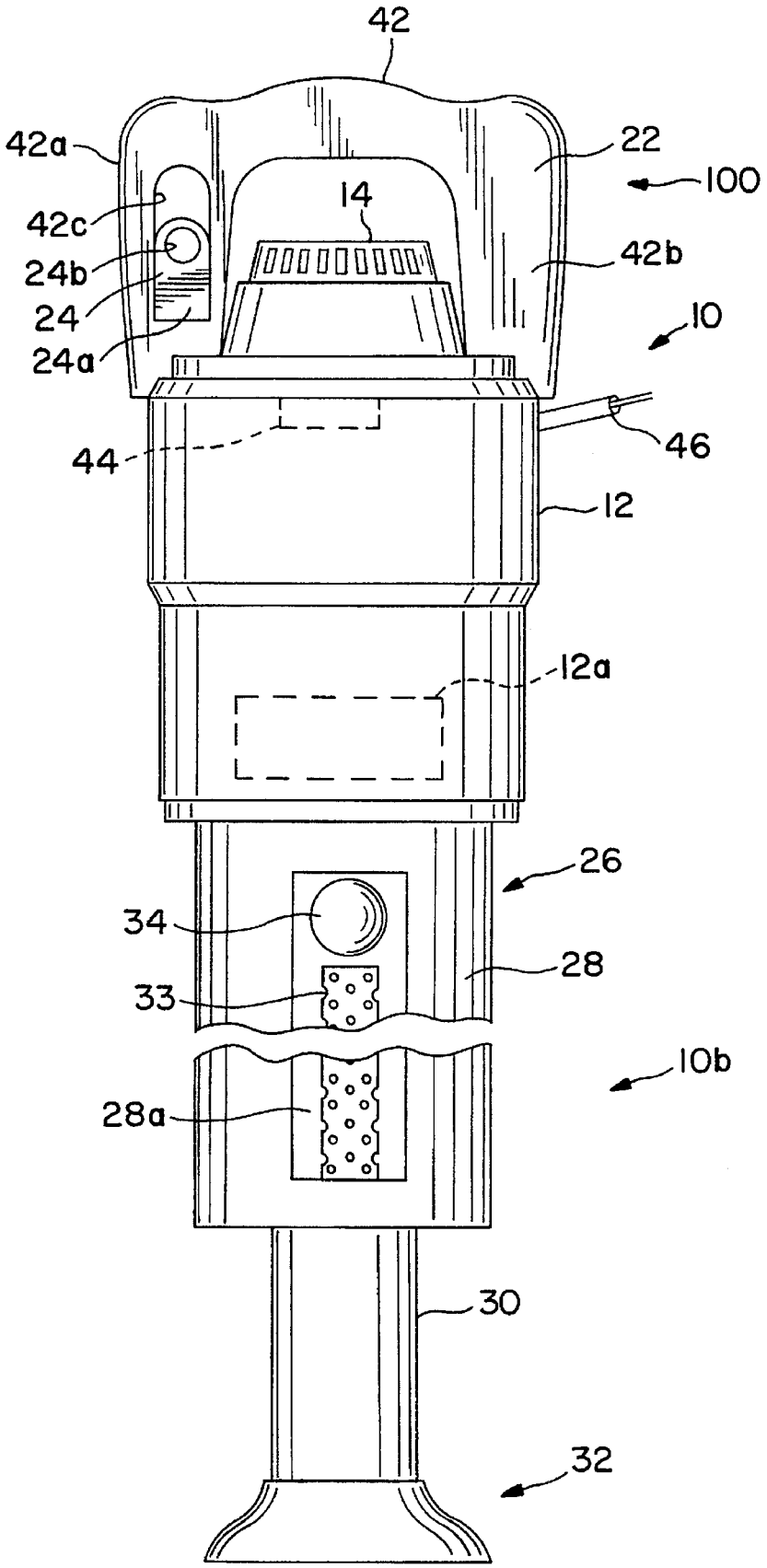
FIG. 1 is an front elevational view of drain opening apparatus according to the invention.
Figure 2:
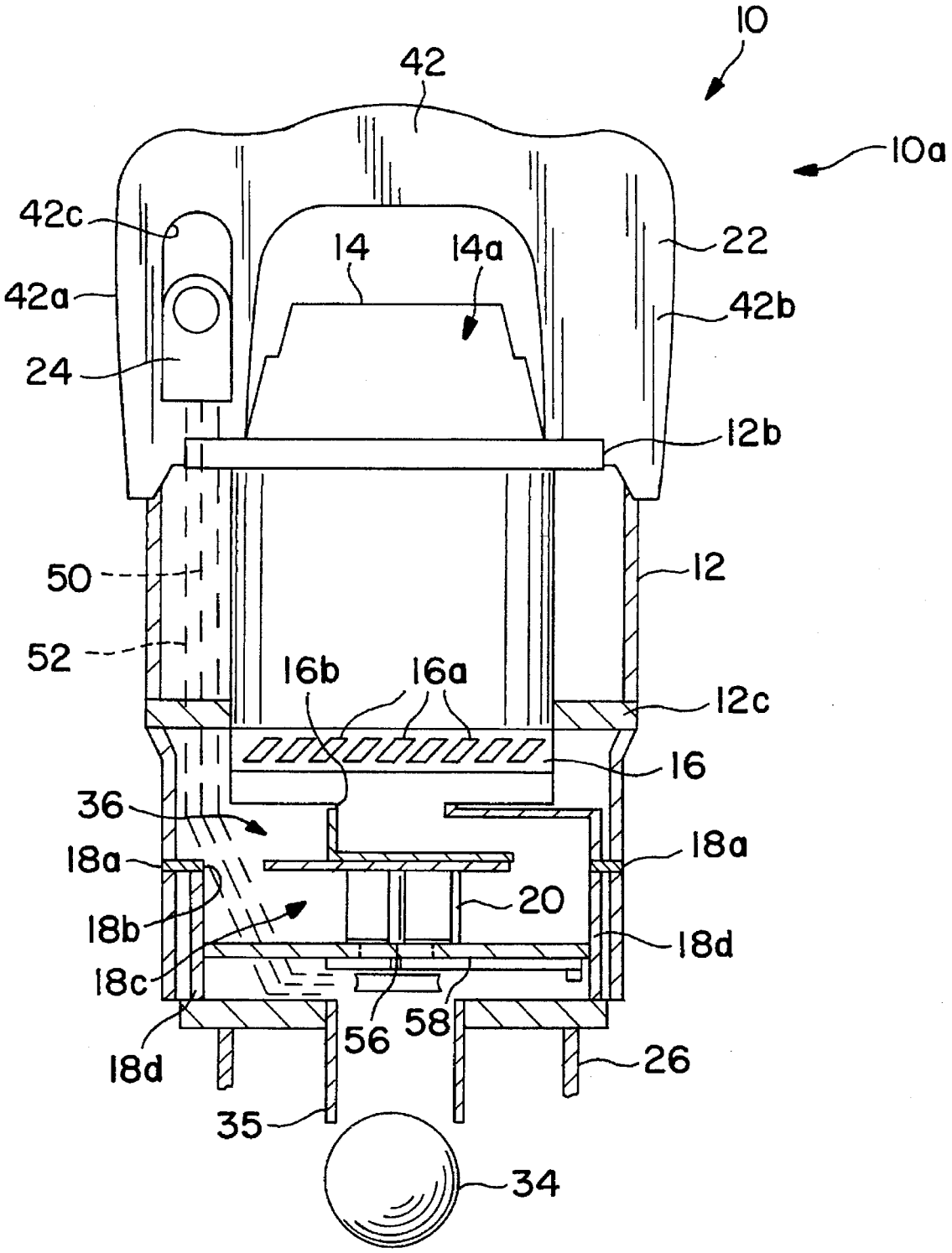
FIG. 2 is a front elevational view, partially in section, of the upper portion of the apparatus of FIG. 1 illustrating the general arrangement of internal components.

Referring now to FIGS. 1 and 2 of the drawing, a preferred embodiment of drain opening apparatus 10 according to the invention includes an outer housing 12 for enclosing principal components including motor 14 and blower fan 16, air control manifold 18 for directing pressure and vacuum pulses to a drain, and flapper valve 20 forming part of the control manifold and providing the means for directing pressure and vacuum pulses. The outer housing has an opening 12*a* for air flow (i.e., inlet of ambient air and exhaust of evacuated air) into and from the control manifold.

A grip 22 together with a finger actuated slide trigger 24 provide for holding and operating the unit from its top end 10*a*. The finger actuated slide manipulates the flapper valve selectively to apply pressure or vacuum pulses to a drain.

A collection chamber or receptacle 26 with a wholly or partially transparent outer wall 28 occupies the lower portion 10*b* of the apparatus and supports a vertically disposed inlet/outlet pipe or duct 30 to a drain. A variety of fittings 32 are available for applying the apparatus to different kinds of drains and plumbing fixtures.

In the embodiment shown in FIG. 1, the collection receptacle 26 is provided with a window 28*a* in the outer wall, and visible through the window are a perforated pipe 33 and a ball float 34 for a check valve 35. The perforated pipe communicates with the duct 30 to drain for inlet of water to the collection receptacle. The ball check valve floats on the surface of any water filling the receptacle above the perforated pipe, and blocks entry of water into the control manifold as shown in FIG. 2. Should this condition occur (i.e., blocked control valve entry) the motor pitch will change alerting the operator to apply a pressure pulse to the receptacle to purge collected water back to drain.

For operating the unit, the user switches "on" the motor driven fan 16 which creates both a source of positive pressure and vacuum, or more precisely, air over-pressure and air under-pressure at the blower outlet 16*a* and inlet 16*b* ports, respectively. The motor-fan rotates in one direction only with air always flowing from air inlet-to-blower-to-air outlet. Air flow into and out of the blower is directed through the air control manifold 18 with the flapper valve being manipulated by the user for selectively directing air flow to provide pressure pulses to drain from ambience or to ambience from drain (i.e., vacuum pulses).

Figure 3:
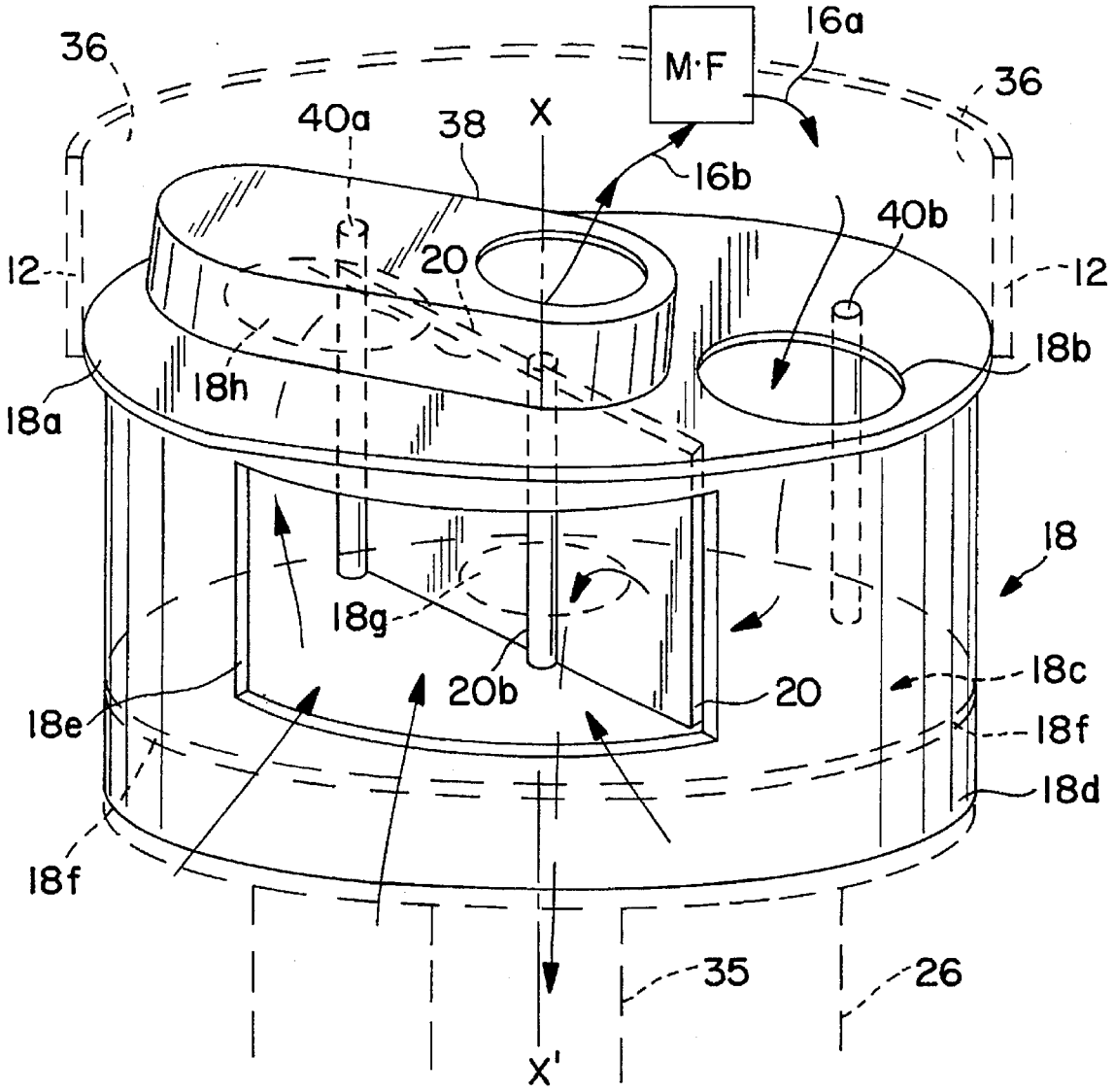
FIG. 3 is a perspective view of the control manifold component of the apparatus of FIG. 1 illustrated in position for applying pressure pulses to a drain.
Figure 4:
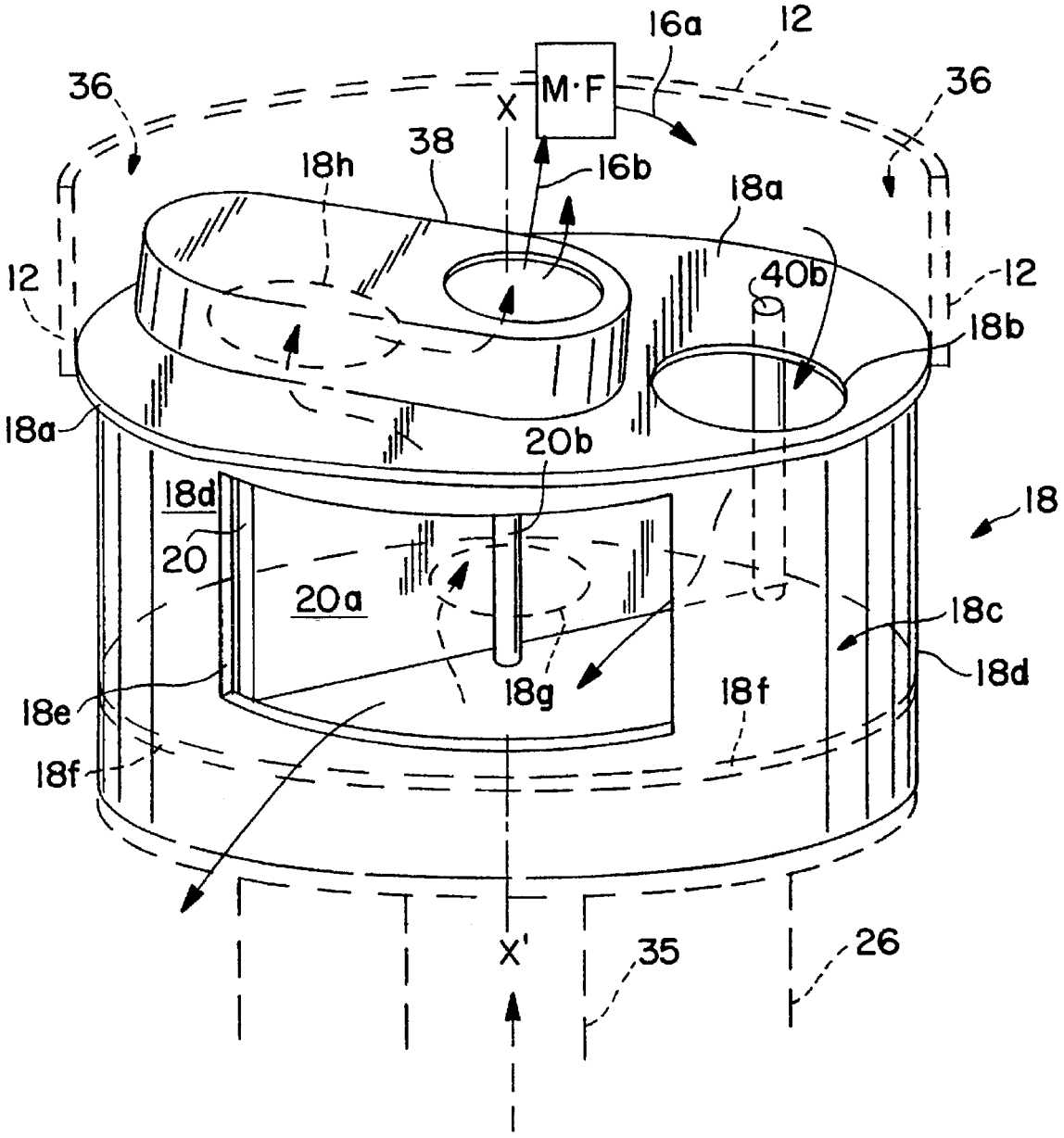
FIG. 4 is a perspective view of the control manifold illustrated in position for applying vacuum pulses to a drain.

FIGS. 2–4 illustrate the internal arrangement of the motor-fan (represented as M–F in FIGS. 3 and 4), air control manifold 18 with flapper valve 20, and interconnected air passages for applying pressure and vacuum pulses to drain. The motor-fan comprises a unitary electric motor 14 and fan or blower 16 arranged vertically within the outer housing 12 and supported between an upper ring 12*b* and an lower ring 12*c*. An air cooling vent 14*a* for the motor extends above the upper ring for the purpose of ventilating the motor to prevent overheating during motor operation.

The fan air outlet ports 16*a* are located within an air pressure plenum 36 defined at its upper margin by motor support ring 12*c* and by the top plate 18*a* of the control manifold and by the outer housing wall 12. An air flow port 18*b* in the top plate 18*a* admits pressurized air from the fan and plenum 36 into the interior 18*c* of the control manifold.

The control manifold 18 is positioned axially beneath the air pressure plenum 36 and comprises an upstanding side wall 18*d* having a port 18*e* to ambience, a bottom plate 18*f* with a two-way port 18*g* for applying both pressure and vacuum pulses to drain, the top plate 18*a* having a pressure port 18*b* communicating with the pressure plenum, and a vacuum port 18*h* communicating with the fan inlet 16*b* via an enclosed vacuum chamber 38. The vacuum chamber directs air flow from the interior of the control manifold to the motor-fan air inlet.

With this arrangement and with the fan operating, air always flows from the manifold interior 18*c* through vacuum port 18*h* and vacuum chamber 38 into the fan air inlet 16*b*, and from the fan outlet 16*a* into the air pressure plenum 36 and through port 18*b* for return to the control manifold interior 18*c*.

Air flow through the control manifold and the selective application of pressure pulses or vacuum pulses to the drain is accomplished by means of the spring loaded flapper valve 20 within the control manifold. The valve is in the form of a rectangular plate 20*a* supported for rotation about a shaft 20*b* positioned along the central axis X–X' of the apparatus. With a cylindrical manifold, the valve lies diagonally and is movable between two positions: a pressure position in which pressure pulses are directed to drain (FIG. 3), and a vacuum position in which vacuum pulses are applied to the drain (FIG. 4). Spaced, vertically oriented posts 40*a* and 40*b* act as stops for the valve for both pressure and vacuum positions.

Figure 5:
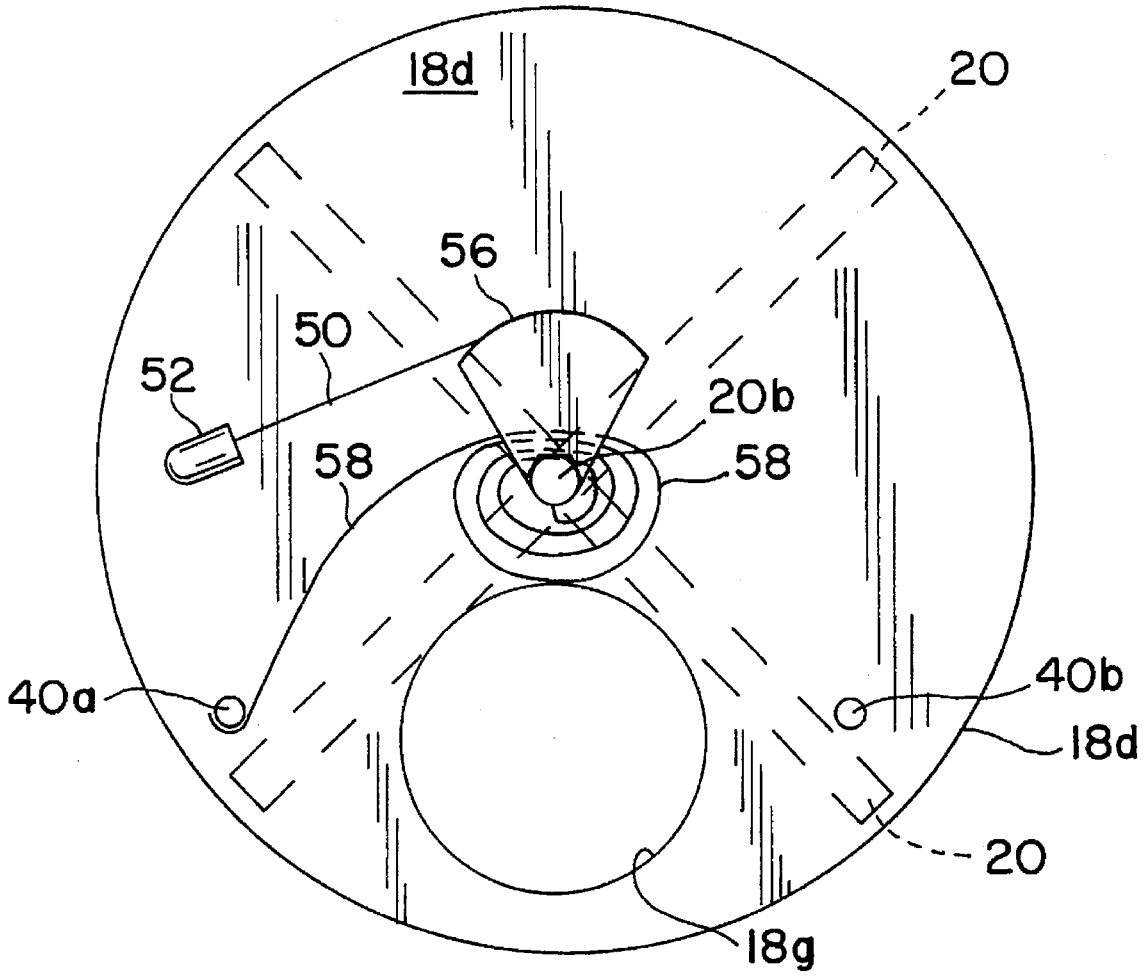
FIG. 5 is a bottom plan view of the control manifold of FIGS. 3 and 4 illustrating the mechanism for moving the flapper valve within the manifold.

The valve's normal (spring biased) position is the vacuum position in which the fan draws air from the drain and exhausts to ambience from the two-way duct 30 (FIG. 1), through the collection receptacle 26, into the control manifold 18*c* via the two-way bottom port 18*g*, through the vacuum chamber 38, into the fan blades, through the pressure plenum 36, again through port 18*b* into the control manifold on the other side of the valve 20 and to ambience via exhaust port 18*e*. It will be observed in FIG. 4 that the operating fan draws air from the rear side of the valve 20 creating a pressure differential with respect to the front face which is at ambient pressure. The differential acts in concert with the valve spring 58 (FIG. 5) in fixing the vacuum position of the valve as "normal". The vacuum position is preferred as "normal" because, when clearing a drain, a pressure pulse first applied to a blocked drain tends to splash water from the drain which creates an unpleasant condition for the operator.

The valve has a pressure position shown in FIG. 3 in which the fan draws air from ambience and exhausts to the drain. Air is drawn into the control manifold through the ambience port 18*e*, flows through the vacuum port 18*h*, vacuum chamber 38 into the fan; from the fan into the air pressure plenum 36, port 18*b*, manifold interior 18*c*, through the two-way port 18*g* into the collection receptacle 26, and through the two-way duct 30 into the drain.

A handle 42 (FIGS. 1 & 2) with upright legs 42*a* and 42*b* extends over the top of the apparatus from side-to-side enabling the user to grip and manipulate the unit from above down into position over a clogged drain. A switch 44 and power cord 46 for the motor are fitted on the apparatus.

The handle is also provided with a slide trigger 24 positioned in an opening 42*c* in one of the handle uprights 42*a*. The trigger 24 is in the form of a plate 24*a* with finger engaging aperture 24*b* by which the user manipulates the flapper valve. A cable 50 through tube 52 (FIGS. 2 & 5) interconnects the lower end of the trigger to a pivot cam 56 projecting at a right angle from the valve mounting shaft 20*b*. A biasing spring such as coil spring 58 is coiled about and connected to the mounting shaft for biasing the valve into vacuum position, and through the cable 50, positioning the slide trigger 24 is its lower position. In order to switch to the positive pressure mode, the user simply lifts the trigger moving the flapper valve to the pressure position. It will be seen therefore that the operator can position the apparatus over a drain opening and rapidly manipulate the trigger and valve between pressure and vacuum modes for application to and clearing of the drain.

The collection receptacle depends from the underside of the control manifold and, together with the two-way duct extending from the bottom of the receptacle, provides an air flow path for both pressure and vacuum pulses between the manifold and the drain. The receptacle may be entirely transparent and fabricated of transparent plastic, or partially transparent and fitted with a window. A section of porous pipe forming an extension of the two-way duct acts as a filter to solids entering the receptacle chamber. Any liquid drawn from a drain with a vacuum pulse is retained in the collection receptacle and may be returned after the drain is clear by applying a pressure pulse to the collection receptacle.

Figure 6:
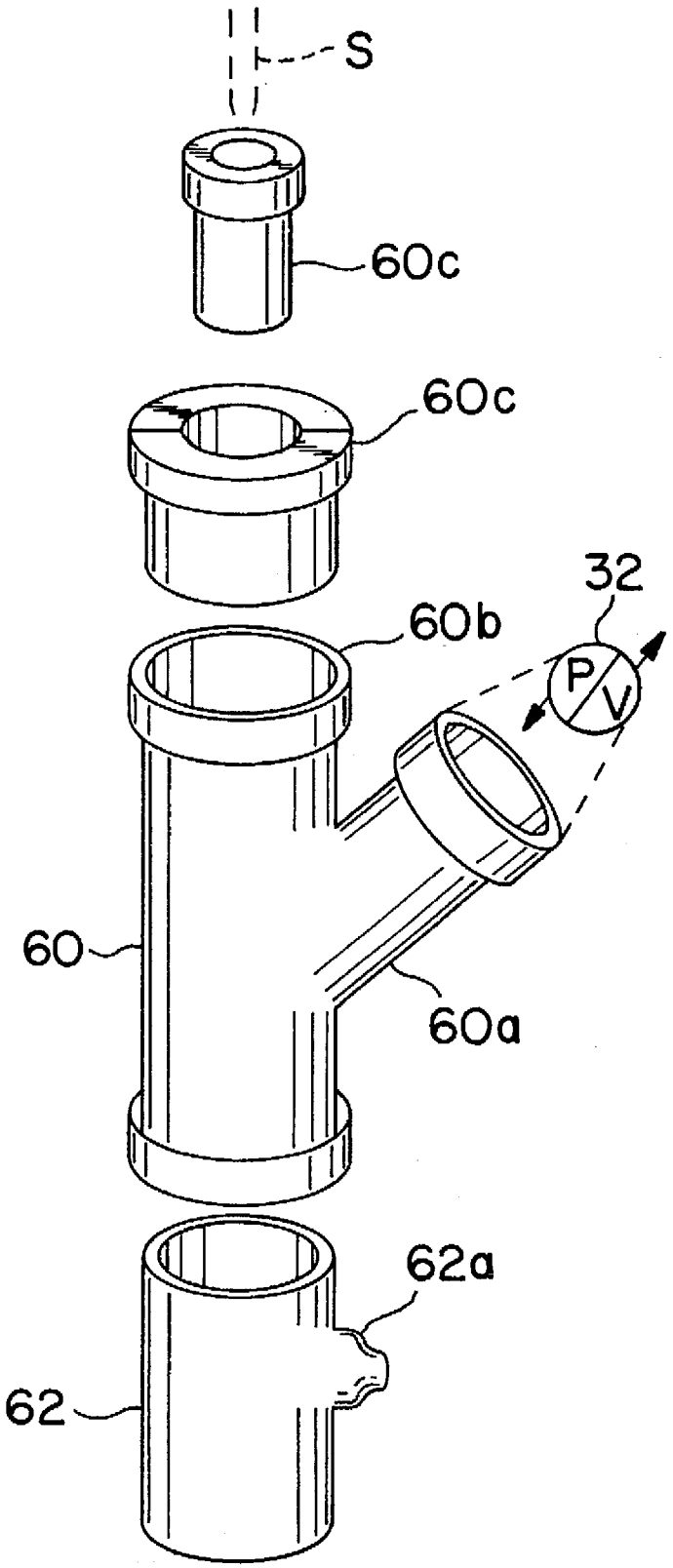
FIG. 6 is an exploded perspective view of accessories for applying the apparatus to various types of drains.

A set of accessories is illustrated in FIG. 6 for applying the apparatus of the invention to a drain along with other implements such as a snake and a water and detergent flush.

The accessories are organized around a "wye" adapter 60 and a water and detergent adapter 62. The "wye" adapter is a straight section of pipe with an oblique branch 60*a*. An inlet 60*b* to the straight section receives a snake S positioned by one or more nesting split collets 60*c* which center the snake in the drain line. The branch inlet 60*a* receives pressure/vacuum pulses applied through the fitting 32 through the apparatus with the pulses working in concert with the snake to clear the drain.

The water and detergent 62 adapter comprises a straight section of pipe with a coupling 62*a* for receiving a water hose or water/detergent applicator for supplying detergent for aiding in the breakup of a drain line blockage. After the drain is clear, the water/detergent applicator is useful in cleaning the snake as it is being withdrawn from the drain.

I claim:

1. An apparatus for opening drains comprising an elongate generally tubular housing having a central axis, a top end and a bottom end, a handle member for gripping and positioning the apparatus vertically with respect to a drain, a motor-fan unit aligned along the central axis, the motor-fan having an air inlet port defining a source of vacuum and an air pressure outlet port defining a source of pressure, an enclosed air pressure plenum chamber within the tubular housing for receiving pressurized air from the motor-fan outlet, a control manifold positioned in axial alignment within the tubular housing and adjacent the plenum, the control manifold having an outer wall, a top plate and a bottom plate together defining a manifold chamber, an opening in the outer wall for porting the manifold chamber to ambience, a valve member rotatably positioned in the manifold chamber for dividing the chamber into a pressure subchamber and a vacuum subchamber and for selectively porting each subchamber to ambience through the outer wall opening, a pressure port in the top plate for admitting pressurized air from the plenum to the pressure subchamber of the control manifold, a vacuum port in the top plate communicating with the motor-fan air inlet for creating under pressure in the vacuum subchamber of the control manifold, a two-way port in the bottom plate of the control manifold for selectively communicating with the pressure and vacuum subchambers of the control manifold for the purpose of applying pressure and vacuum pulses to a drain, a two-way duct for connecting the two-way port to a drain, and means for rotating the valve member to a pressure position wherein air flows through the ambience port into the vacuum subchamber, through the motor-fan into the air pressure plenum, into the pressure subchamber and through the two-way port to drain in the form of a pressure pulse, and to a vacuum position wherein a vacuum pulse is created in the drain as air is evacuated and flows from the drain through the two-way port into the vacuum subchamber, through the motor-fan into the air pressure plenum, into the pressure subchamber and through the ambience port.

2. A control manifold for an apparatus utilizing a pressure source and a vacuum source for clearing drains comprising a cylindrical outer wall, a top plate and a bottom plate together with the outer wall defining a generally cylindrical manifold chamber, an opening in the outer wall for porting the manifold chamber to ambience, a valve member rotatably positioned in the manifold chamber for dividing the chamber into a pressure subchamber and a vacuum subchamber and for selectively porting each subchamber to ambience through the outer wall opening, a pressure port in the top plate for admitting pressurized air from the pressure source to the pressure subchamber of the control manifold, a vacuum port in the top plate communicating with the vacuum source for creating under pressure in the vacuum subchamber of the control manifold, a two-way port in the bottom plate of the control manifold for selectively communicating with the pressure and vacuum subchambers of the control manifold for the purpose of applying pressure and vacuum pulses to a drain.

3. An apparatus for opening drains comprising a motor driven fan defining a pressure source and a vacuum source; a control manifold having an interior chamber, a pressure port, a vacuum port, and an inlet/outlet port; means for porting the interior chamber to atmosphere; the motor driven fan being mounted above the control manifold; a valve member located in the interior chamber and cooperating to divide the interior chamber into a pressure chamber and a vacuum chamber; means for connecting the pressure chamber to the pressure source through the pressure port; means for connecting the vacuum chamber to the vacuum source through the vacuum port; means for connecting the inlet/outlet port of the interior chamber to a drain; said means for connecting the inlet/outlet port to drain including a receptacle located under and communicating with the inlet/outlet port, and a two-way duct extending from the receptacle to a drain; the valve member having a first position in which the pressure source and pressure chamber issue pressure pulses to the drain through the inlet/outlet port and in which the vacuum chamber is ported to atmosphere; the valve member having a second position in which the vacuum source and vacuum chamber issue vacuum pulses to the drain through the inlet/outlet port and in which the pressure chamber is ported to atmosphere; means for moving the valve member between the first and second positions rapidly to apply pressure pulses and vacuum pulses through the inlet/outlet port and through the receptacle and the two-way duct to drain for dislodging and removing the drain blockage; and the receptacle for receiving effluent from the drain when the drain is connected to the vacuum source.

* * * * *